US005520108A

United States Patent [19]

Hasegawa et al.

[11] Patent Number: 5,520,108

[45] Date of Patent: May 28, 1996

[54] EJECTED MASTER PLATE PROCESSING DEVICE FOR A STENCIL PRINTING DEVICE

[75] Inventors: Takanori Hasegawa; Akira Yasuda, both of Tokyo-to, Japan

[73] Assignee: Riso Kagaku Corporation, Japan

[21] Appl. No.: 495,344

[22] Filed: Jun. 27, 1995

[30] Foreign Application Priority Data

Jun. 30, 1994 [JP] Japan ..... 6-149047

[51] Int. Cl.[6] ..... B41L 13/08

[52] U.S. Cl. ..... 101/121; 101/477; 100/245

[58] Field of Search ..... 101/114, 116–121, 101/141, 142, 477, 479; 100/45, 80, 216, 217, 240, 245; 53/116, 117

[56] References Cited

U.S. PATENT DOCUMENTS

| | | | |
|---|---|---|---|
| 4,134,338 | 1/1979 | Selman | 101/122 |
| 4,339,293 | 7/1982 | Takahashi et al. | 101/116 |
| 4,566,383 | 1/1986 | Matsushita et al. | 101/121 |
| 4,846,057 | 7/1989 | Endo et al. | 101/477 |
| 5,090,310 | 2/1992 | Motoe et al. | 101/114 |
| 5,133,919 | 7/1992 | Hasegawa et al. | 101/114 |
| 5,323,699 | 6/1994 | Motoe et al. | 101/477 |

*Primary Examiner*—Ren Yan
*Attorney, Agent, or Firm*—Dickstein, Shapiro & Morin

[57] ABSTRACT

To positively compress ejected master plates at a high compression ratio without requiting any complex structure, a piston member for compressing ejected master plates is placed in an ejected master plate box for receiving ejected master plates from an ejected master plate receiving inlet so as to be moveable between a first position and a second position, and the movement of the piston member toward the second position causes the stencil master plates to be compressed against an end wall of the ejected master plate box. The piston member is provided with a motor-driven suction fan which draws air out of the ejected master plate box to move the piston member toward the second position, and is biased toward the first position by a spring member.

10 Claims, 4 Drawing Sheets

MASTER PLATE EJECT COMMAND
LOCK CONTROL UNIT
NORMAL DRIVE CONTROL UNIT
1
3
5
7
9
11
13
14
15
17
19
21
23
25
27
29
31
33
35
37
39
41
45
A
S

MASTER PLATE EJECT COMMAND
LOCK CONTROL UNIT
NORMAL DRIVE CONTROL UNIT
37
39
41
1
3
5
7
8
8a
8b
9
11
13
14
15
17
19
21
23
25
27
29
31
33
35
45
A
S

EJECTED MASTER PLATE PROCESSING DEVICE FOR A STENCIL PRINTING DEVICE

TECHNICAL FIELD

The present invention relates to an ejected master plate processing device for a stencil printing device, and in particular to an ejected master plate processing device which compresses ejected master plates.

BACKGROUND OF THE INVENTION

As shown in Japanese patent publication (kokoku) No. 61-54708, and Japanese patent laid open publications (kokai) Nos. 60-71466 and 02-175277, it has been proposed, in a stencil printing device, to remove the used stencil master plate from the printing drum or eject the master plate, and store the master plate in an ejected master plate box after compressing it as it is being conveyed or in the ejected master plate box. Compressing the ejected master plates is essential in maximizing the number of used master plates that can be stored in the ejected master plate box.

As shown in Japanese patent laid open publication (kokai) No. 02-175277, it is preferable to compress the used master plates by forcing a motor driven pressure member onto the master plates to a high compression ratio. However, the necessary reciprocating movement of the pressure member can be accomplished by a highly complex structure involving the use of a rack and pinion mechanism, and a relatively long rack is required to achieve a large reciprocating stroke of the pressure member.

BRIEF SUMMARY OF THE INVENTION

In view of such problems of the prior art, a primary object of the present invention is to provide an ejected master plate processing device for a stencil printing device which can positively compress used stencil master plates at a high compression ratio without requiting any complex structure.

A second object of the present invention is to provide an ejected master plate processing device for a stencil printing device which can achieve a relatively long pressing stroke without requiting any excessively long component parts.

A third object of the present invention is to provide an ejected master plate processing device for a stencil printing device which can be automatically operated without requiting any complex control mechanism.

These and other objects of the preset invention can be accomplished by providing a ejected master plate processing device for a stencil printing device, comprising: an ejected master plate box including an ejected master plate receiving inlet provided in a side wall thereof, and an end wall provided in an axial end thereof; a piston member slidably disposed in the ejected master plate box so as to be axially moveable between a first position remote from the end wall and a second position adjacent to the end wall, passing the ejected master plate receiving inlet, a front end of the piston member defining a compression chamber in cooperation with the side wall and end wall of the ejected master plate box; a suction fan provided in the piston member for drawing air out of the compression chamber; drive control means for actuating the suction fan so as to create a negative pressure in the compression chamber, and move the piston member from the first position to the second position by virtue of the negative pressure; return means for returning the piston member from the second position to the first position; whereby an ejected master plate introduced into the ejected master plate box from the ejected master plate receiving inlet is compressed between the front end of the piston member and the end wall of the ejected master plate box as the piston member is moved to the second position by the negative pressure created by the suction fan. The front end of the piston member opposing the end wall may comprise a mesh surface portion so that the drawing of air out of the compression chamber by the suction fan may be facilitated.

The device may further include ejected master plate conveying means for positively drawing the ejected master plate into the ejected master plate box, and it may consist of a conveyor such as a belt conveyor or may make use of a simple duct in which negative pressure is produced by the suction fan. In the latter case, when the suction fan provided on the piston member draws air out of the compression chamber, a negative pressure condition is produced in the compression chamber, and the resulting pressure difference first causes the stencil master plate to be introduced into the ejected master plate box.

Once the ejected master plate is introduced into the compression chamber either by a conveyor or by suction, the suction fan is turned, and the resulting negative pressure created in the compression chamber causes the piston member to move from the first position to the second position whereby the used master plate recovered in the compression chamber is compressed between the front end of the piston member and the end wall of the ejected master plate box or the compression chamber.

The return means may consist of a spring member biasing the piston member for compressing ejected master plates toward the first position or a reverse drive control means for controlling the reverse actuation of the electric motor. The ejected master plate processing device of the present invention may comprise lock means for selective engagement of the piston member at the first position. In the ejected master plate processing device of the present invention, the ejected master plate receiving inlet may be opened between the first and second positions, and may be adapted to be closed by the piston member as it moves between the two positions.

When the return means consists of a spring member, upon cessation of the drawing of air out of the ejected master plate box by the suction fan following the compression of the used master plate, the interior of the ejected master plate box is restored to the atmospheric pressure, and the piston member is returned to the first position by the spring force of the spring member.

When the return means consists of the reverse drive control means, following the compression of the master plate, the suction fan is reversed by reversing the actuation of the electric motor, and air is thereby introduced into the ejected master plate box or the compression chamber. The resulting pressure difference causes a movement of the piston member away from the second position to the first position.

When the lock means is provided, the suction fan may be actuated so as to draw master plate into the ejected master plate box by suction, and once the ejected master plate is received in the ejected master plate box, the engagement of the piston member by the lock means may be disengaged. Preferably, the lock means comprises a self-locking latch which can be selectively released by a solenoid device. Alternatively, the introduction of the used master plate can be effected by a belt conveyor or the like.

When the ejected master plate receiving inlet is closed by the piston member moving toward the second position, an even higher negative pressure is produced inside the ejected master plate box or the compression chamber. A front end of the piston member opposing the end wall comprises a mesh surface portion.

The ejected master plate processing device may further comprise a pressure sensor for detecting a compression of the master plate, the drive control means terminating the actuation of the suction fan upon detection of a certain compression of the master plate by the pressure sensor. Thus, the pressure sensor can determine the timing of automatically reversing the movement of the piston member in a simple manner.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
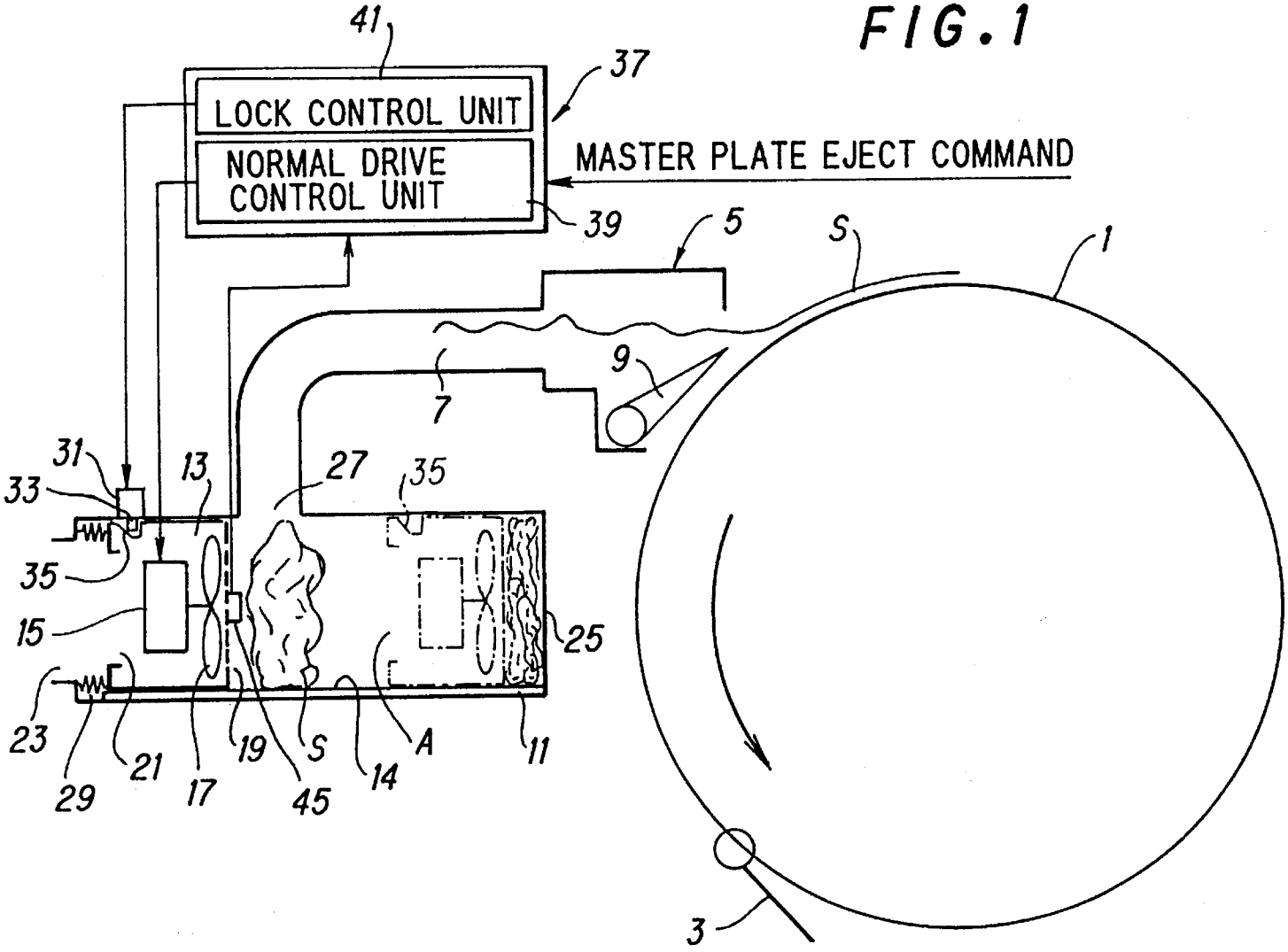
FIG. 1 is a schematic structural view of an embodiment of the ejected master plate processing device for a stencil printing device according to the present invention.

FIG. 1 shows an embodiment of the ejected master plate processing device for a stencil printing device according to the present invention. In FIG. 1, numeral 1 denotes a printing drum. The printing drum 1 has a master plate clamp 3 on its outer circumferential surface which clamps a leading edge of a stencil master plate S, and is rotatively actuated by a drive mechanism not shown in the drawing in counter clockwise direction as seen in the drawing around its axial center line.

An ejected master plate processing device 5 is placed on one side of the printing drum 1. The ejected master plate processing device 5 comprises an ejected master plate duct 7 opening toward the outer circumferential surface of the printing drum 1 at its one end, and peeling claws 9 are provided on the opening end of the ejected master plate duct 7 for peeling off the master plate S from the printing drum 1, The peeling claws 9 are similar to those used in the conventional ejected master plate processing devices, and can be moved between an operative position for approaching the outer circumferential surface of the printing drum and peeling off the stencil master plate S from the printing drum 1, and a retracted position for staying away from the outer circumferential surface of the printing drum 1 by a drive mechanism although it is not shown in the drawing.

An ejected master plate box 11 is connected to the other end of the ejected master plate duct 7. A piston member 13 for compressing ejected master plates is movably provided between a first position (left position) and a second position (fight position) in the ejected master plate box 11. The piston member 13 for compressing ejected master plates is allowed to reciprocate inside the ejected master plate box 11 guided by a linear motion guide 14 which may include a linear beating to reduce friction.

The piston member 13 for compressing ejected master plates is provided with a suction fan 17 rotatively actuated by an electric motor 15. The suction fan 17 opposes a mesh surface portion 19 provided on the front end of the piston member 13, and, by being reversibly driven by the electric motor 15, draws air out of the ejected master plate box 11 and expels the air to the atmosphere from air outlets 21 and 23 provided on the rear end of the piston member 13 and the left end of the ejected master plate box 11 as seen in the drawing. The electric power supplied to the electric motor 15 is controlled by a normal drive control unit 39 of a control device 37 so as to normally drive the electric motor 15.

The mesh surface portion 19 of the piston member 13 opposes the right end wall 25 of the ejected master plate box 11 as seen in the drawing, and compresses the ejected master plates against the end wall 25. The end wall 25 may be adapted to be selectively opened so as to allow removal of the master plates stored in the ejected master plate box 11.

An ejected master plate receiving inlet 27 provided in the ejected master plate box 11 connects to the ejected master plate duct 7, and opens out at an intermediate point of the ejected master plate box 11 located between the first and second positions, preferably offset toward the first position. As the piston member 13 leaves the first position, the ejected master plate receiving inlet 27 is closed by the piston member 13, and the communication between a space A defined in the ejected master plate box 11 between the end wall 25 thereof and the mesh surface portion 19 of the piston member 13 with the ejected master plate duct 7 is closed. A tension coil spring 29 is engaged between the piston member 13 and the ejected master plate box 11, and biases the piston member 13 leftward as seen in the drawing or toward the first position.

The ejected master plate box 11 is provided with a lock claw 33 adapted to be actuated by a solenoid device 31. The lock claw 33 selectively engages with an engagement recess 35 of the piston member 13 when the latter is located at the first position to restrain the same at the first position. The solenoid device 31 is controllably energized by a lock control unit 41 of the control device 37, and can actuate the lock claw 33 to a lock release position.

The operation of the ejected master plate processing device having the above described structure is now described in the following.

When a master plate is about to be ejected and a master plate ejection signal is supplied to the control device 37, the peeling claws 9 are moved to the operative position by an actuator not shown in the drawing. The electric motor 15 is powered by the normal drive control unit 39 with the piston member 13 engaged at the first position by the lock claw 33 so as to turn the suction fan 17 in the normal direction.

At the same time, the master plate damp 3 is moved to the unclamp position, and the printing drum 1 is turned in counter clockwise direction as seen in the drawing. The counter clockwise rotation of the printing drum 1 causes the stencil master plate S mounted on the outer circumferential surface of the printing drum 1 to be peeled off from the printing drum 1 by the peeling claws 9.

The rotation of the suction fan 17 in the normal direction produces a negative pressure condition in the ejected master plate duct 7 and the ejected master plate box 11, and the stencil master plate S introduced into the ejected master plate duct 7 is drawn toward the ejected master plate receiving inlet 27 of the ejected master plate box 11, and is eventually received in the ejected master plate box 11. If necessary, the ejected master plate duct 7 may be slanted at a suitable angle or may even be vertically disposed so that the ejected master plate may be reliably dropped into the ejected master plate box 11 with the aid of the gravitational force without activation of negative pressure produced by the rotation of the suction fan 17.

Figure 3:
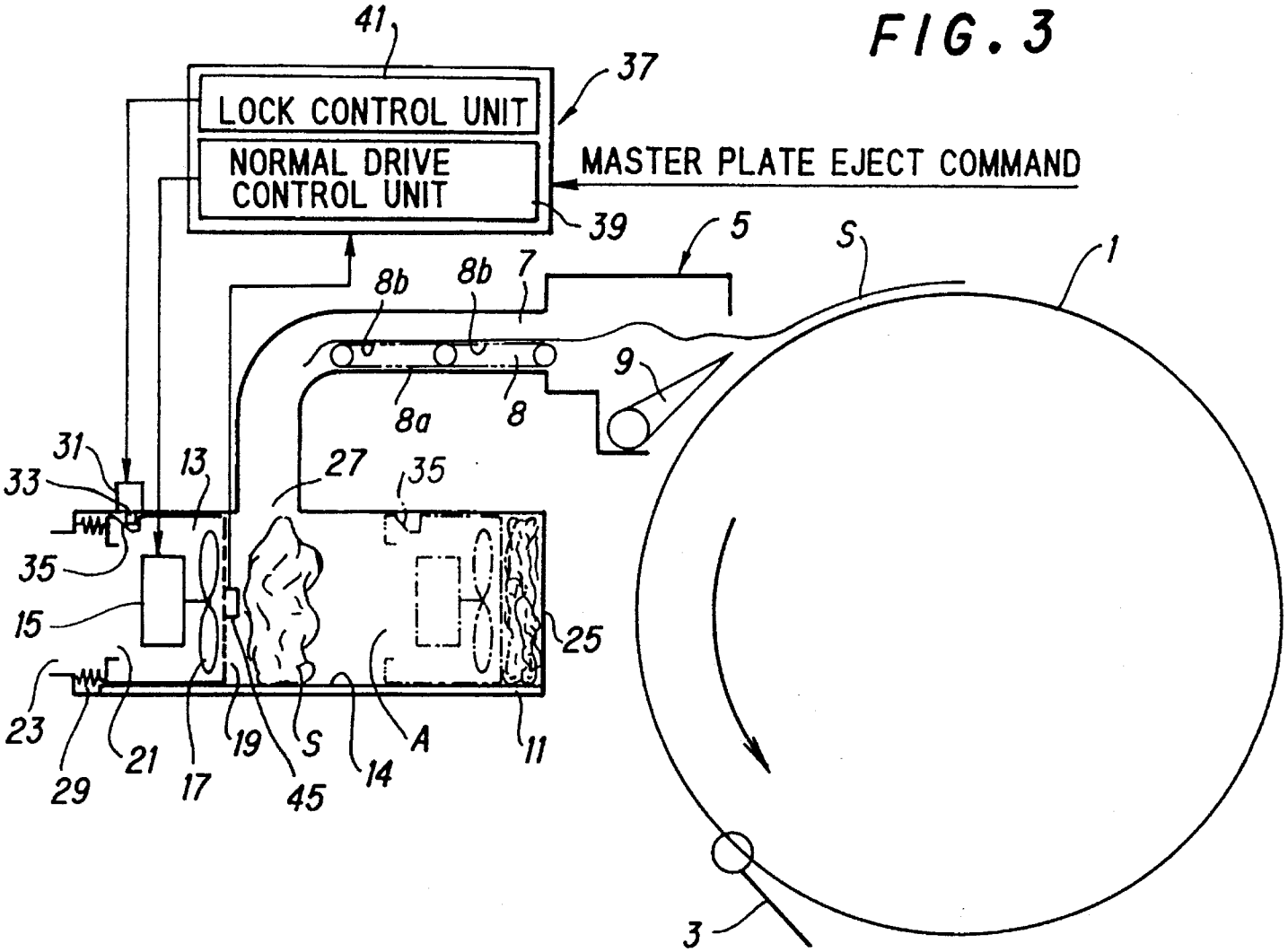
FIG. 3 is a schematic structural view of another embodiment of the ejected master plate processing device for a stencil printing device according to the present invention.

However, as shown in FIG. 3, a belt conveyor 8 may be provided in the ejected master plate duct 7 extending between the ejected master plate processing device 5 and the ejected master plate receiving inlet 27 to forward the used master plate S peeled off by the peeling claws 9 into the space A defined in the ejected master plate box 11. The belt conveyor 8, in this case, comprises an endless belt 8*a* and a plurality of suction hole 8*b*, for passing negative pressure, in the belt 8*a*. The ejected master plate sheet S is securely put on the suction holes 8*b* in the belt 8*a* by activation of suction means (not shown in the drawings) to be forwarded into the space A.

Upon elapsing of a certain time period after a master plate eject signal is supplied to the control device 37, the solenoid device 31 is energized by the lock control unit 41 under the timer control of the control device 37. As a result, the lock claw 33 is driven to the lock release position, and is disengaged from the engagement recess 35.

This disengagement action releases the locked condition of the piston member 13, and as the space A in the ejected master plate box 11 is already in the negative pressure condition at this time, the piston member 13 is moved from the first position to the second position under the pressure difference against the spring force of the tension coil spring 29.

This movement causes the ejected master plate receiving inlet 27 to be closed by the piston member 13, and the resulting closure of the communication between the space A in the ejected master plate box 11 and the ejected master plate duct 7 further increases the negative pressure of the space A in the ejected master plate box with the result that the piston member 13 is all the more powerfully moved toward the second position.

Thus, the stencil master plate S already received in the ejected master plate box 11 is compressed between the mesh surface portion 19 of the piston member 13 and the end wall 25 of the ejected master plate box 11 as indicated by the imaginary lines in the drawings.

Upon elapsing of a certain time period after the energization of the solenoid device 31, the supply of electric power to the electric motor 15 is terminated under the timer control of the control device 37, and the rotation of the suction fan 17 in the normal direction is discontinued. As a result, the negative pressure in the space A in the ejected master plate box is lost, and the piston member 13 is returned to the original first position under the spring force of the tension coil spring 29 to be ready for the next session of the processing of ejected master plates.

The lock claw 33 and the engagement recess 35 are configured so as to achieve a self-locking action which does not require any power for establishing the engagement between the lock claw 33 and the engagement recess 35. These two parts can be disengaged by the energization of the solenoid device 31 of a short duration. Thus, when the piston member 13 has returned to the first position, the lock claw 33 engages with the engagement recess 35.

Figure 2:
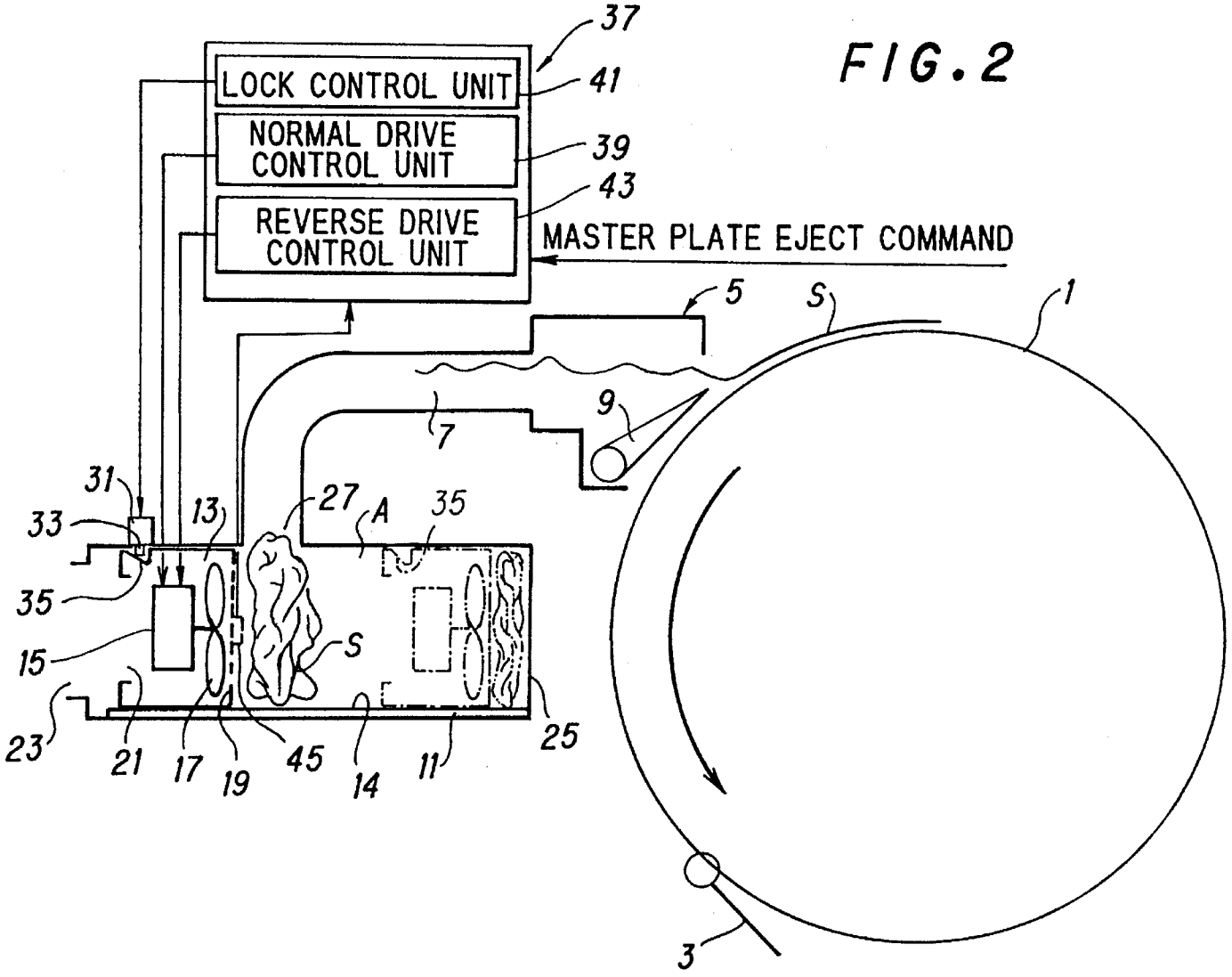
FIG. 2 is a schematic structural view of another embodiment of the ejected master plate processing device for a stencil printing device according to the present invention.

FIG. 2 shows another embodiment of the ejected master plate processing device for a stencil printing device according to the present invention. In FIG. 2, the pails corresponding to those of the previous embodiment are denoted with like numerals.

In this embodiment, the motor 15 consists of a reversible motor, and can selectively turn the suction fan 17 in either direction. The rotation of the suction fan 17 in the reverse direction flows air into the ejected master plate box 11, and produces a high pressure therein.

The reverse rotative actuation of the electric motor 15 is controlled by the electric current supplied from the reverse drive control unit 43 of the control device 37. In this embodiment, the tension coil spring 29 is omitted.

Figure 4:
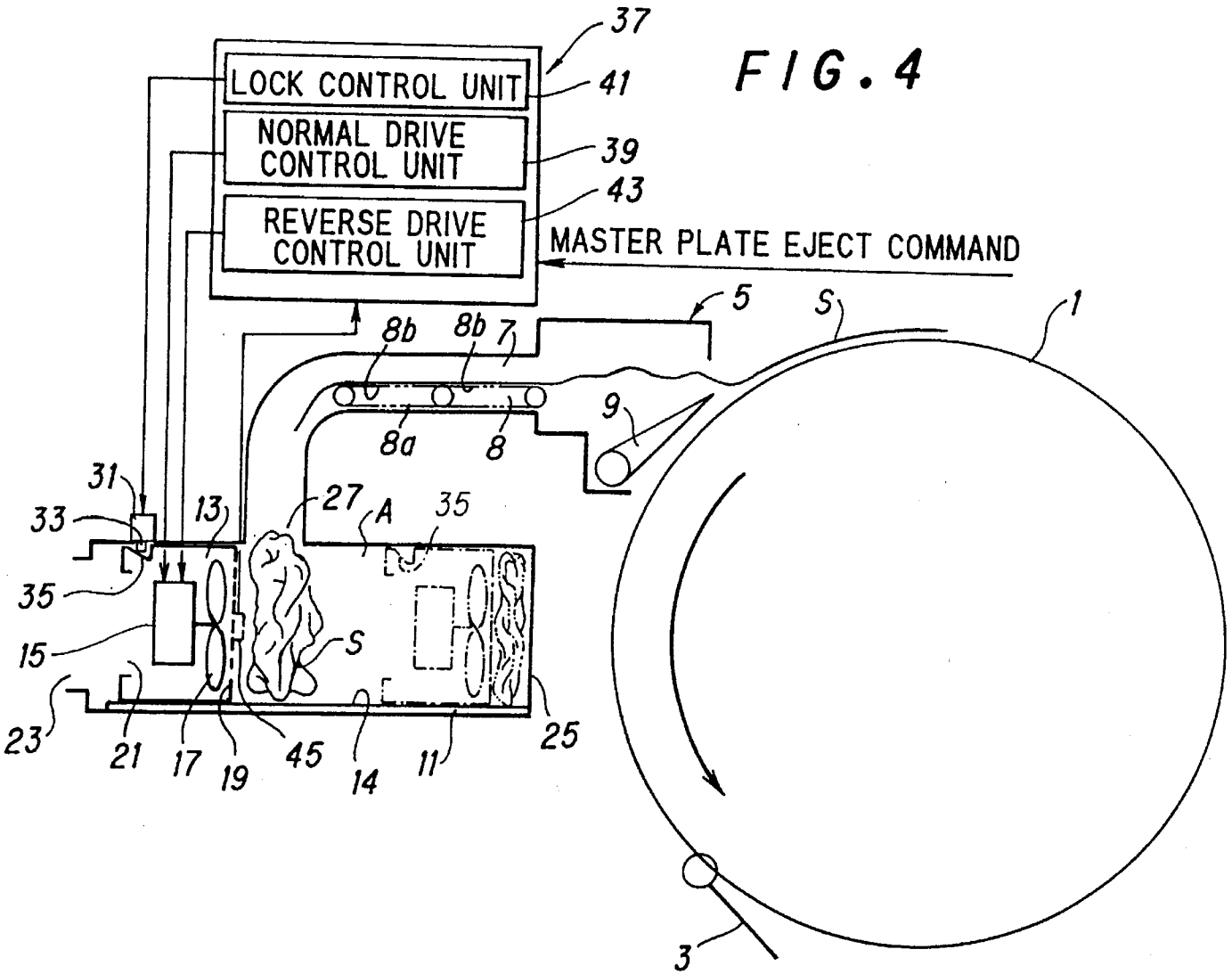
FIG. 4 is a schematic structural view of another embodiment of the ejected master plate processing device for a stencil printing device according to the present invention.

In this embodiment also, when a master plate eject signal is supplied to the control device 37, the ejected master plate duct 7 and the ejected master plate box 11 are brought into a negative pressure condition by the rotative actuation of the suction fan 17 in the normal direction by the electric motor 15, and the stencil master plate S in the ejected master plate duct 7 is forwarded to the ejected master plate box 11 via the ejected master plate receiving inlet 27. If necessary, the ejected master plate duct 7 may be slanted at a suitable angle or may even be vertically disposed so that the ejected master plate may be reliably dropped into the ejected master plate box 11 with the aid of the gravitational force without activation of negative pressure produced by the rotation of the suction fan 17. However, as shown in FIG. 4, a belt conveyor 8 may be provided in the ejected master plate duct 7 extending between the ejected master plate processing device 5 and the ejected master plate receiving inlet 27 to forward the used master plate S peeled off by the peeling claws 9 into the space A defined in the ejected master plate box 11. The belt conveyor 8, in this case, comprises an endless belt 8*a* and a plurality of suction hole 8*b*, for passing negative pressure, in the belt 8*a*. The ejected master plate sheet S is securely put on the suction holes 8*b* in the belt 8*a* by activation of suction means (not shown in the drawings) to be forwarded into the space A.

Upon elapsing of a certain time period after a master plate eject signal is supplied to the control device 37, the solenoid device 31 is energized, and the lock claw 33 is disengaged from the engagement recess 35.

This disengagement action releases the engagement of the piston member 13, and the piston member 13 is moved from the first position to the second position under the pressure difference so that the stencil master plate S which is already introduced into the ejected master plate box 11 is compressed between the mesh surface portion 19 of the piston member 13 and the end wall 25 of the ejected master plate box 11.

Upon elapsing of a certain time period after the energization of the solenoid device 31, the rotative actuation of the electric motor 15 in the normal direction is terminated, and the reverse drive control unit 43 actuates the electric motor 15 is actuated so as to rotatively drive the suction fan 17 in the reverse direction.

The reverse rotation of the suction fan 17 causes air to be forced into the ejected master plate box 11, thereby creating a high pressure condition in the ejected master plate box 11, and the piston member 13 is returned to the first position under the thus created pressure difference to be ready for the next session of the processing of ejected master plates.

In this embodiment, the piston member 13 is returned to the initial position by the timer control, but it is also possible to attach a pressure sensor 45 to the front surface of the piston member 13 to detect if the master plate S has been sufficiently compressed between the mesh surface potion 19 of the piston member 13 and the end wall 25 of the ejected master plate box 11, and to return the piston member 13 to the initial position according to the result of pressure detection.

As can be understood from the above description, according to the ejected master plate processing device of the present invention, a negative pressure condition is produced inside the ejected master plate box by the suction fan provided in the piston member, and the piston member is moved under the pressure difference until the master plate is compressed between the piston member and the end wall of the ejected master plate box. Thus, the overall structure is not required to be highly complex, and a long rack would not be required even when the reciprocating stroke is relatively long so that the stencil master plate can be positively compressed at a high compression ratio with a highly compact structure.

If the piston member is returned to the original position by the spring force of the spring member, the return action can be effected in a highly reliable fashion. If the piston member is returned to the original position by the air pressure created by the reverse rotation of the suction fan, there is no need for a return spring, and the structure can be even more simplified.

If the lock means is provided, the suction fan may be driven so as to draw the stencil master plate into the ejected master plate box under the negative pressure. Thus, the forwarding of the ejected master plate into the ejected master plate box can be carried out without requiring any special conveying means, and the reliability of recovering the stencil master plate into the ejected master plate box can be improved as compared to the case of using the gravitational force for recovering the ejected stencil master plate.

If the ejected master plate receiving inlet is dosed by the movement of the piston member, the negative pressure in the ejected master plate box can be increased, and an even more reliable ejected master plate processing can be achieved.

Although the present invention has been described in terms of specific embodiments thereof, it is possible to modify and alter details thereof without departing from the spirit of the present invention.

What we claim is:

1. An ejected master plate processing device for a stencil printing device, comprising:

an ejected master plate box including an ejected master plate receiving inlet provided in a side wall thereof, and an end wall provided in an axial end thereof;

a piston member slidably disposed in said ejected master plate box so as to be axially moveable between a first position remote from said end wall and a second position adjacent to said end wall, passing said ejected master plate receiving inlet, a front end of said piston member defining a compression chamber in cooperation with said side wall and end wall of said ejected master plate box;

a suction fan provided in said piston member for drawing air out of said compression chamber;

drive control means for actuating said suction fan so as to create a negative pressure in said compression chamber, and move said piston member from said first position to said second position by virtue of said negative pressure; and return means for returning said piston member from said second position to said first position;

whereby an ejected master plate introduced into said ejected master plate box from said ejected master plate receiving inlet is compressed between said front end of said piston member and said end wall of said ejected master plate box as said piston member is moved to said second position by said negative pressure created by said suction fan.

2. An ejected master plate processing device for a stencil printing device according to claim 1, further comprising ejected master plate conveying means for forwarding said ejected master plate into said ejected master plate box, said ejected master plate conveying means comprising a duct leading to said ejected master plate box, and belt conveyor means provided therein.

3. An ejected master plate processing device for a stencil printing device according to claim 1, further comprising ejected master plate conveying means for forwarding said ejected master plate into said ejected master plate box, said ejected master plate conveying means comprising a duct leading to said ejected master plate box which is adapted to be placed in a negative pressure condition by activation of said suction fan.

4. An ejected master plate processing device for a stencil printing device according to claim 1, wherein said return means consists of a spring member for biasing said piston member toward the first position.

5. An ejected master plate processing device for a stencil printing device according to claim 1, wherein said return means consists of reversible drive control means for rotatively actuating said suction fan in a reverse direction.

6. An ejected master plate processing device for a stencil printing device according to claim 1, further comprising lock means for selective engagement of said piston member at said first position.

7. An ejected master plate processing device for a stencil printing device according to claim 6, wherein said lock means comprises a self-locking latch which can be selectively released by a solenoid device.

8. An ejected master plate processing device for a stencil printing device according to claim 1, wherein said ejected master plate receiving inlet opens out between said first and second positions, and is adapted to be closed by said piston member as it moves between said first and second positions so that said negative pressure is enhanced when said ejected master plate receiving inlet is closed by said piston member moving away from said first position.

9. An ejected master plate processing device for a stencil printing device according to claim 1, wherein a front end of said piston member opposing said end wall comprises a mesh surface portion.

10. An ejected master plate processing device for a stencil printing device according to claim 1, further comprising a pressure sensor for detecting a compression of said master plate, said drive control means terminating said actuation of said suction fan upon detection of a certain compression of said master plate by said pressure sensor.

* * * * *